United States Patent [19]

Polett et al.

[11] Patent Number: 4,499,599

[45] Date of Patent: Feb. 12, 1985

[54] STACKABLE FLEXIBLE BULK CONTAINER

[76] Inventors: Walter J. Polett; Muriel S. Polett, both of 61 Algonquin Trail, Medford Lakes, N.J. 08055

[21] Appl. No.: 455,194

[22] Filed: Jan. 3, 1983

[51] Int. Cl.[3] ..... B65D 33/02; B65D 33/06; B65D 88/22

[52] U.S. Cl. ..... 383/6; 383/9; 383/20; 383/24; 383/32

[58] Field of Search ..... 150/33, 107; 383/7, 383/17, 20, 24, 40, 18, 14, 29, 6, 8, 32

[56] References Cited

U.S. PATENT DOCUMENTS

| | | | |
|---|---|---|---|
| 582,588 | 5/1897 | Hoose | 383/18 X |
| 676,660 | 6/1901 | Mogg | 383/20 |
| 733,542 | 7/1903 | Converse | 383/20 X |
| 2,823,155 | 2/1958 | Brown et al. | 383/17 X |
| 3,550,663 | 12/1970 | Johnston | 150/33 X |
| 3,802,613 | 4/1974 | Droeger | 150/33 X |
| 4,081,011 | 3/1978 | Krause | 383/17 |
| 4,096,929 | 6/1978 | Frey et al. | 150/33 X |
| 4,180,112 | 12/1979 | Bovet | 383/40 X |
| 4,207,937 | 6/1980 | Sandeman et al. | 383/20 X |
| 4,300,608 | 11/1981 | Cuthbertson | 383/7 |
| 4,301,848 | 11/1981 | Beavin et al. | 383/20 |
| 4,356,853 | 11/1982 | Sekiguchi | 383/24 |

FOREIGN PATENT DOCUMENTS

| | | | |
|---|---|---|---|
| 2322563 | 4/1977 | France | 383/7 |
| 744727 | 2/1956 | United Kingdom | 383/17 |
| 916585 | 1/1963 | United Kingdom | 383/20 |

*Primary Examiner*—William Price
*Assistant Examiner*—Sue A. Weaver
*Attorney, Agent, or Firm*—Duffield & Lehrer

[57] ABSTRACT

A stackable flexible bulk container includes a bag portion of woven polypropylene and is comprised of a bottom wall, a top wall and an encircling side wall. At least two lifting strap loops are provided so that the container can be lifted by the tongs of a forklift truck. To enable the tongs to enter the loops without manual assistance, relatively rigid devices are associated with the ends of the loops to hold them upright and opened. The loops are also held outwardly away from the center of the bag so that similar containers can be stacked without interfering with the loops of the container below.

5 Claims, 12 Drawing Figures

STACKABLE FLEXIBLE BULK CONTAINER

BACKGROUND OF THE INVENTION

The present invention is directed toward a flexible bulk container and more particularly toward such a container which includes normally raised lifting strap loops which can be engaged by the forks of a forklift truck and which containers can be stacked one on top of the other without interfering with the lifting loops of the container below.

Large flexible fabric bags for containing and transporting granular or powdered bulk material have been used for many years and their use is becoming increasingly more popular. This is primarily due to their relatively low cost and to the fact that when the bags are empty, they take up very little space and are relatively light.

When filled, the flexible bulk containers may carry a cubic meter or more of material and may weigh in excess of two tons. Straps are normally provided and are securely fastened to the bags adjacent the top thereof to form lifting loops which can cooperate with the forks of a forklift truck or other lifting device when it becomes necessary to transport a full bag. Containers of this type are shown, for example, in U.S. Pat. Nos. 4,010,784; 4,207,937; 4,300,608; 4,301,848 and in British Application No. GB 2,063,816 A published June 10, 1981.

The lifting straps or loops of prior art containers have primarily been comprised of a flexible material. Thus, when it was desired to lift a prior art bag utilizing the tongs of a forklift truck, it was usually necessary for a second worker to hold the loops in an upright, open position so that the tongs could be inserted therethrough. Two workers were, therefore, required thus increasing the costs of transportation.

Attempts have been made to provide loops which include stiffening members therein so as to maintain the loop in an upward and open position. In this way, a single worker operating the lift truck could insert the tongs of the forklift through the loops without the aid of a second worker. Examples of such self-sustaining loops are described in U.S. Pat. No. 4,300,608 and published British Application No. 2,063,816 A.

It is common to stack filled containers on top of each other for storage purposes and, for this reason, the lifting loops in the last two mentioned prior art documents are constructed in such a way that they collapse under the weight of the container above but are designed to recover to an upright, open position when the stacking force is removed. It has been found, however, that these loops do not always recover particularly after they have been used a number of times and it has been found that a second worker is needed to reopen and align the loops so that the container can be lifted by a forklift truck.

SUMMARY OF THE INVENTION

The present invention is designed to overcome the problems of the prior art described above. The stackable flexible bulk container of the invention includes a bag portion of woven polypropylene and is comprised of a bottom wall, a top wall and an encircling side wall. At least two lifting strap loops are provided so that the container can be lifted by the tongs of a forklift truck. To enable the tongs to enter the loops without manual assistance, relatively rigid devices are associated with the ends of the loops to hold them upright and opened.

The loops are also held outwardly away from the center of the bag so that similar containers can be stacked without interfering with the loops of the container below.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
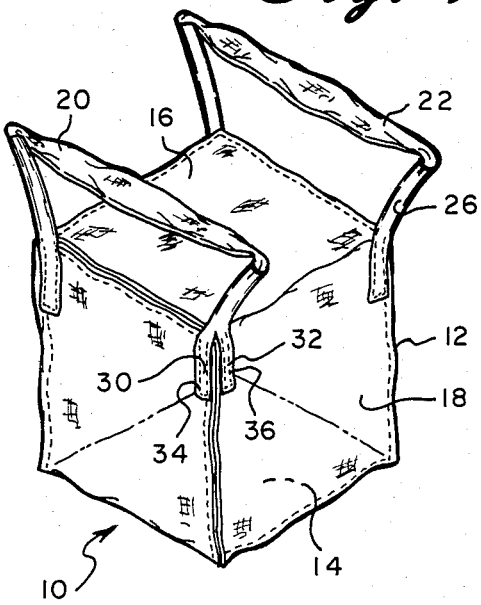
FIG. 1 is a perspective view of a stackable flexible bulk container constructed in accordance with the principles of the present invention.

Referring now to the drawings in detail wherein like reference numerals have been used throughout the various figures to illustrate like elements, there is shown in FIG. 1 a perspective view of a stackable flexible bulk container constructed in accordance with the principles of the present invention and designated generally as 10. The container 10 is comprised of a bag portion 12 including a bottom wall 14 (shown in phantom), a top wall 16 and surrounding side walls 18. The bag 12 does not, per se, form a part of the instant invention and can be constructed in a conventional manner from woven polypropylene or other desired material. Furthermore, the bottom wall 14 and top wall 16 may have closable spouts therein for filling or emptying the bag.

A pair of lifting strap loops 20 and 22 are provided adjacent the top of the container 10 for the purpose of transporting the same. Each loop is comprised of a length of webbing or fabric material, the ends of which are secured to the bag portion 12 by sewing same into the seams in the side walls 18. In the preferred embodiment of the invention, the top and bottom walls 16 and 14 are rectangular and the ends of the lifting loops 20 and 22 are attached to the bag portion at points adjacent the corners of the top 16.

Figure 2:
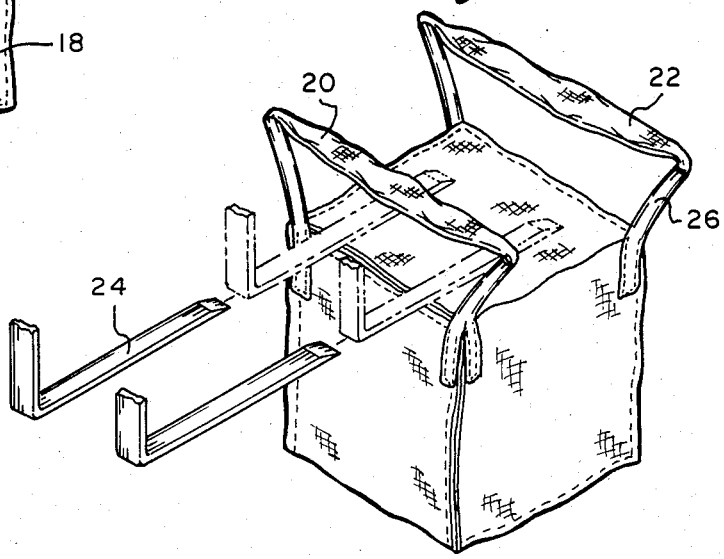
FIG. 2 is a view similar to FIG. 1 but showing how the container can be lifted by the tongs of a forklift truck.

FIG. 2 illustrates the manner in which the container 10 can be transported by the tongs 24 of a forklift truck. This is accomplished by passing the tongs 24 through the open loops 20 and 22. For this purpose, relatively rigid loop sustaining or maintaining devices 26 are provided adjacent the ends of each of the loops 20 and 22. The loop maintaining devices 26 hold the loops in an open position above the top 16 of the bag. Preferably, the devices 26 do not extend the entire length of the loop 20 and 22 but are just long enough to maintain the loops in the open position. In this way, the devices 26 are not engaged by the tongs 24 of the forklift.

Figure 3:
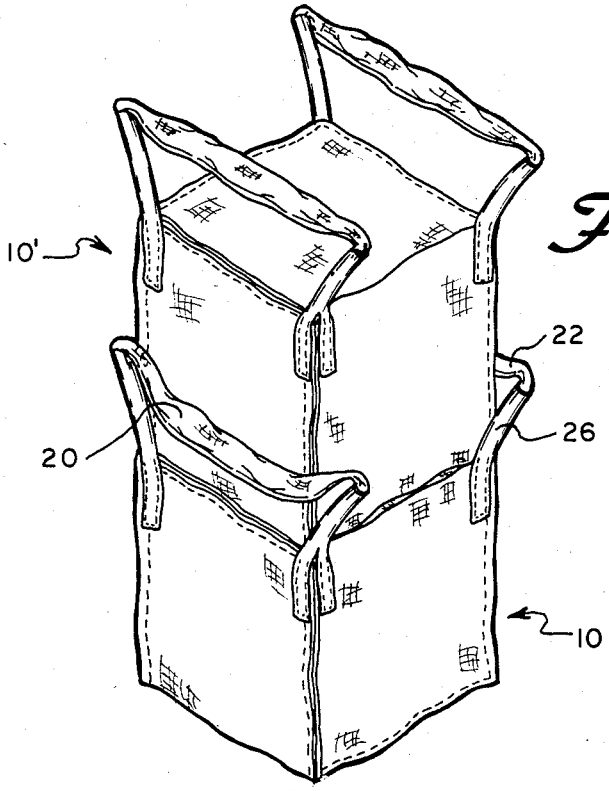
FIG. 3 is a perspective view illustrating the manner in which containers can be stacked.

As can best be illustrated by FIG. 3, the loop maintaining devices 26 not only maintain the loops in an upward and open position but also hold the loops slightly outwardly away from the outer perimeter of the bag portion 12. In this way, a second and similarly constructed container 10' can be stacked on top of the container 10 without contacting or in any way interfering with the lifting loops 20 or 22 or the loop maintaining devices 26.

Figure 4:
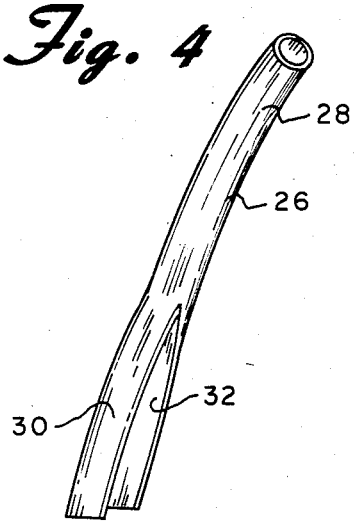
FIG. 4 is a perspective view of one form of a device for maintaining the lifting loops of the container in proper position.

Details of the loop maintaining devices 26 are shown in FIG. 4. Device 26 is, essentially, comprised of two parts: an upper tubular portion 28 and a pair of legs 30 and 32 depending downwardly therefrom. The legs 30 and 32 may, of course, be formed by slitting the lower portion of the tube from which the upper tubular member 28 is formed. The device 26 is slightly curved along the length thereof as shown so as to extend diagonally upwardly above the top wall of the bag portion and outwardly beyond the maximum dimensions of the bottom of the container.

The loop maintaining device 26 must be assembled onto the lifting loops 20 or 22 when the container 10 is being assembled. This is accomplished by passing the end of the strap material forming the loop 20 or 22 through the upper tubular end 28 of the device 26 and out through the lower portion thereof. The strap material is then secured to the bag portion 12 along the vertical seam of the edges thereof and possibly also along the bottom where the two ends of the strap may be joined. The lower depending legs 30 and 32 of the device 26 are then attached to the corners of the bag portion 12 such as shown at 34 and 36 in FIG. 1. The loop retaining devices 26 are not subjected to any substantial forces. Accordingly, the stitching 34 and 36 need not be as secure as the remaining stitching in the bag portion 12 but must merely be strong enough to hold the devices 26 in position.

Figure 5:
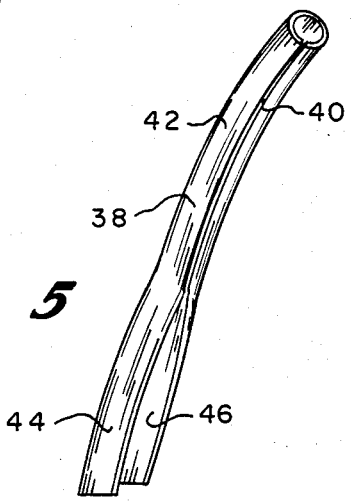
FIG. 5 is a perspective view of a modified form of the device shown in FIG. 4.
Figure 6:
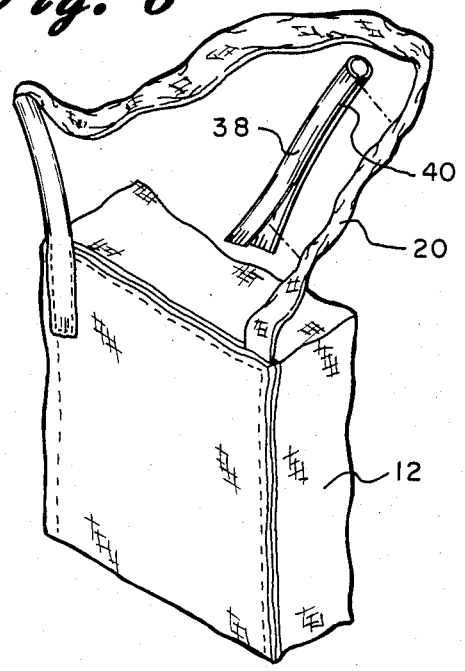
FIG. 6 illustrates the manner in which the device of FIG. 5 is attached to the container.

A modified form of the loop retaining device 26 of FIG. 4 is shown in FIG. 5 and is generally designated 38. Device 38 is similar to the device 26 except that it includes an elongated slot or cut 40 in the upper tubular portion 42 thereof. As a result of this modification, the device 38 can be attached to a lifting loop 20 or 22 after the ends of the strap from which the loop is formed are secured to the remaining parts of the bag portion 12. An illustration of this is shown in FIG. 6. It can be seen that the slit 40 allows the tubular portion 42 to be opened enough to pass the same around the loop 20. The depending legs 44 and 46 of the device 38 can then be sewn or otherwise secured to the bag portion 12.

Figure 7:
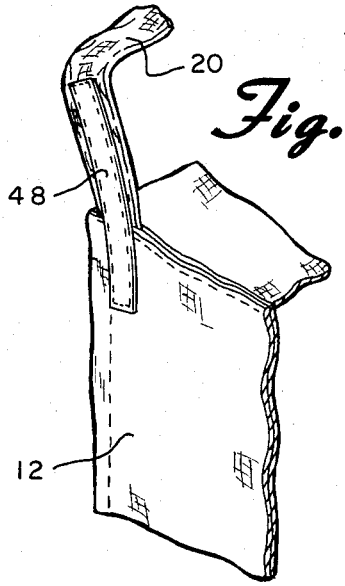
FIGS. 7, 8, 9 and 10 illustrate further modified forms of the lifting loop retaining devices.
Figure 8:
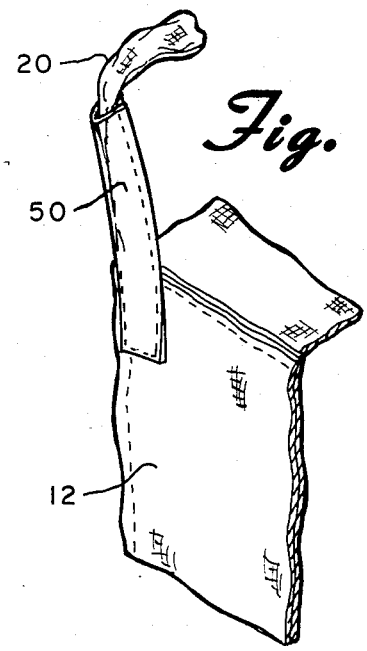
Figure 9:
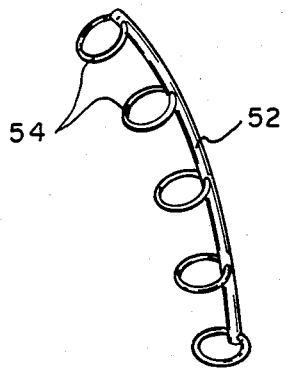
Figure 10:
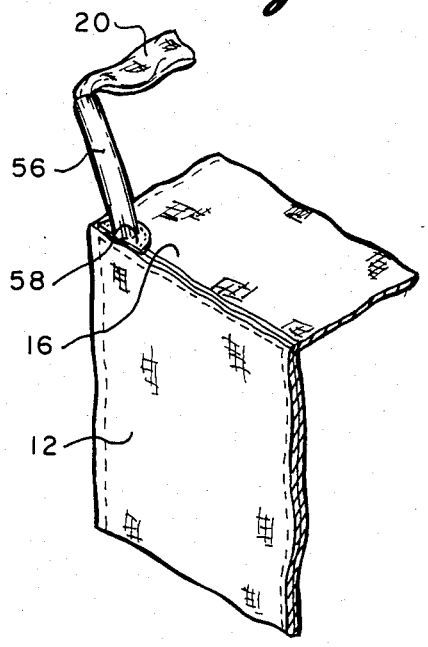

FIGS. 7, 8, 9 and 10 illustrate alternate embodiments of the loop retaining devices which are useful with the present invention. In FIG. 7, a single strip 48 of relatively rigid material is shown sewn to the lower end of a lifting loop. Similarly, a wider strip of the same material can be folded over to form the device 50 shown in FIG. 8. FIG. 9 shows a device including an elongated member 52 and a plurality of hoops 54 which may be placed around the lifting loop 20. The device shown in FIG. 10 is similar to the devices of FIGS. 4 or 5 in that it includes an upper tubular member 56. However, the base portion 58 is horizontally disposed so that the same can be attached to the outermost edge of the top wall 16 of the bag portion 12.

Various other devices may also be used to maintain the lifting loops in the desired position. The actual configuration thereof is not critical so long as the device holds the ends of the lifting loops in a substantially vertical position upwardly above the top wall of the bag and outwardly beyond the periphery of the side walls. The center or bight portion of the lifting loop 20 or 22 will then be held in a substantially horizontal position.

It should be readily apparent that the loop maintaining devices may be constructed of substantially any material. While they are referred to as being relatively rigid, this is relative only to the material from which the loops 20 and 22 are constructed. The devices such as device 26 may actually be somewhat flexible and may be made from a rubber-like material or synthetic plastic. The only requirement being that the devices be rigid enough to maintain the lifting loops 20 and 22 in the desired position.

Figure 11:
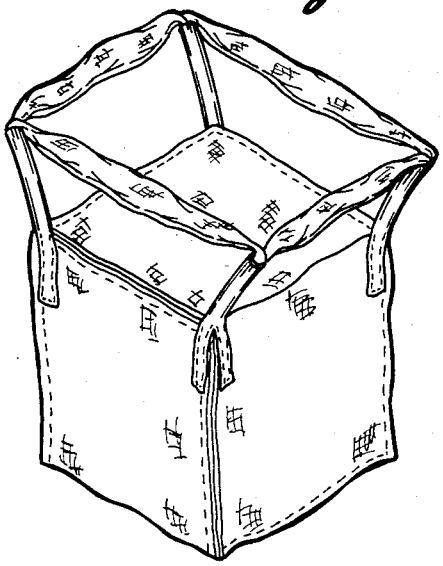
FIGS. 11 and 12 illustrate alternate methods for arranging the lifting loops on the container.
Figure 12:
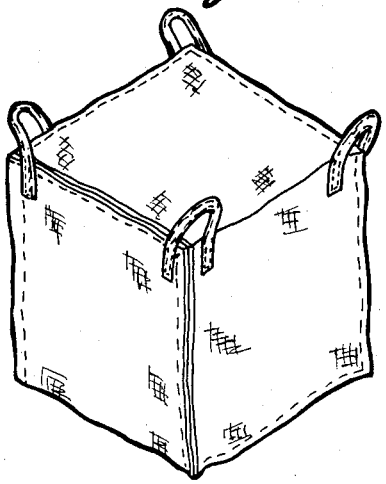

The embodiment of the invention shown in FIGS. 1, 2 and 3 above includes only two lifting loops 20 and 22. It is also possible, however, to have four lifting loops such as shown in FIG. 11. In this way, the container can be lifted from either side or from the front or back. Similarly, the invention can also be practiced utilizing four corner loops as shown in FIG. 12. Other arrangements are also possible depending on the shape of the bag portion of the container.

The present invention may be embodied in other specific forms without departing from the spirit or essential attributes thereof and accordingly, reference should be made to the appended claims rather than to the foregoing specification as indicating the scope of the invention.

We claim:

1. A stackable flexible bulk container comprising:

a bag portion including a bottom, a top wall and an encircling side wall connected to said bottom and top wall and defining the outer perimeter of said bag portion;

a pair of lifting strap loops, each of said loops having a pair of ends secured to said bag portion so that said loops can extend above said top wall, and means for maintaining the substantial portion of said loops in an upward position above the level of said top wall and outwardly beyond the outer perimeter of said bag portion, said maintaining means comprising a substantially vertical relatively rigid member associated with each end of each of said loops, each of said rigid members being secured to said bag portion and extending diagonally upwardly above the level of said top wall and outwardly beyond the maximum dimensions of said bottom whereby a second similarly constructed container can be stacked on top of the bag portion without substantially interfering with said loops, each of said loops including a substantially horizontally disposed flexible material bight portion extending between the upper ends of two of said rigid members.

2. The container as claimed in claim 1 wherein said top wall is substantially rectangularly shaped and wherein the ends of said pair of loops are secured to said bag adjacent the corners of said top wall.

3. The container as claimed in claim 1 including a second pair of lifting strap loops constructed and arranged similar to said first mentioned pair.

4. The container as claimed in claim 1 wherein said rigid members are tubular and surround a portion of the loops with which they are associated.

5. The container as claimed in claim 1 wherein said rigid members are substantially flat.

* * * * *